United States Patent [19]

Volk

[11] Patent Number: 4,583,456

[45] Date of Patent: Apr. 22, 1986

[54] PRINTING MECHANISM

[75] Inventor: Heinrich Volk, Beerfelden, Fed. Rep. of Germany

[73] Assignee: Esselte Pendaflex Corporation, Garden City, N.Y.

[21] Appl. No.: 703,543

[22] Filed: Feb. 20, 1985

[30] Foreign Application Priority Data

Feb. 24, 1984 [DE] Fed. Rep. of Germany ..... 3406776

[51] Int. Cl.[4] ..... B41J 1/20

[52] U.S. Cl. ..... 101/111; 101/109; 101/288

[58] Field of Search ..... 101/105, 111, 110, 109, 101/288

[56] References Cited

U.S. PATENT DOCUMENTS

| | | | |
|---|---|---|---|
| Re. 30,749 | 9/1981 | Hamisch, Jr. | 101/111 |
| 4,271,759 | 6/1981 | Volk | 101/110 |
| 4,325,302 | 4/1982 | Beers | 101/288 |
| 4,392,424 | 7/1983 | Schrotz et al. | 101/111 |

*Primary Examiner*—Edgar S. Burr
*Assistant Examiner*—Tonya Eckstine
*Attorney, Agent, or Firm*—Gerald J. Ferguson

[57] ABSTRACT

A printing mechanism is described comprising a housing (12, 14) in which a plurality of type carriers (20) are disposed which are in a drive connection with coaxially disposed setting wheels (16) each having a center bore. In a space formed by the center bores of the setting wheels a setting shaft (42) is axially displaceable and rotatable. By axial displacement the setting shaft can be brought into a drive connection with each of the setting wheels. On the setting shaft an actuating knob (48) is disposed with the aid of which said shaft can be displaced and turned. In the housing a display indicator means (26, 27, 29) is disposed displaceably parallel to the setting shaft; said means is connected to the setting shaft in such a manner that the latter turns relatively thereto but can be displaced axially only jointly therewith. The display indicator means makes it possible to recognize the type carrier which can be adjusted in the respective axial position of the setting shaft. The connection between the setting shaft and the display indicator means is formed by a substantially circular cap (64) which is mounted with a hub (62) on the setting shaft and on the edge of which the display indicator means is secured.

5 Claims, 3 Drawing Figures

PRINTING MECHANISM

Figure 1:
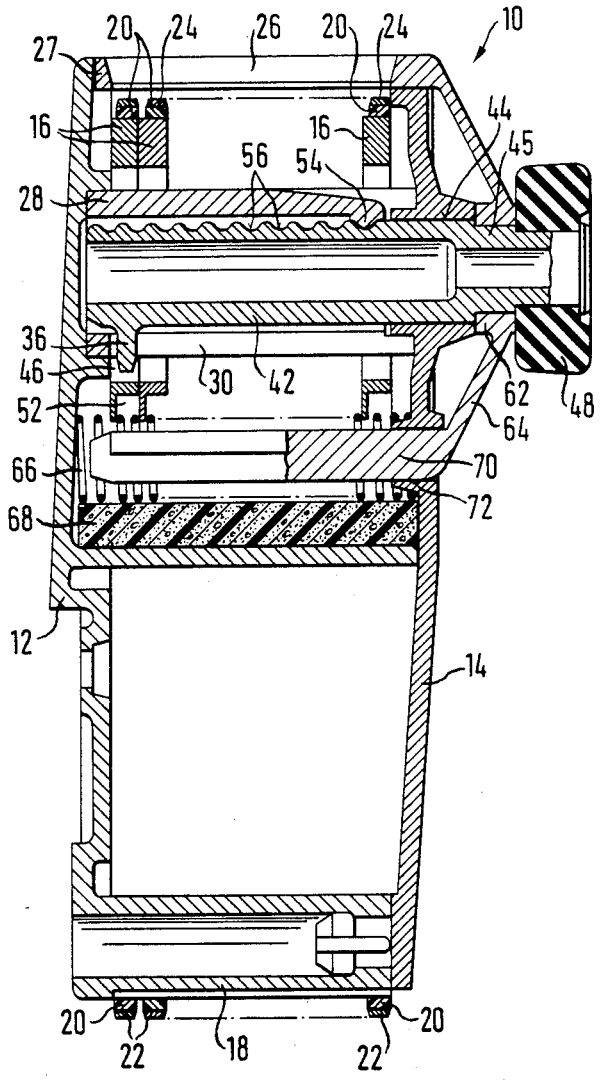

The invention relates to a printing mechanism comprising a housing in which a plurality of type carriers are disposed which are in a drive connection with coaxially arranged setting wheels each having a center bore, a setting shaft which is arranged axially displaceably and rotatably in the space formed by the center bores of the setting wheels and adapted to be brought by axial displacement into a drive connection with each of the setting wheels, an actuating knob disposed on an end portion of the setting shaft for displacement and rotation of the setting shaft and an display indicating means which is arranged in the housing displaceably parallel to the setting shaft and connected to the one end portion of the setting shaft in such a manner that the latter can rotate relatively thereto but is axially displaceable only jointly therewith, the display indicating means being associated with the type carriers in such a manner that its position shows which type carrier in the respective axial position of the setting shaft can be adjusted via the drive connection between the latter and a setting wheel and between the setting wheel and the type carrier.

DE-OS 3,031,820 discloses such a printing mechanism. This printing mechanism is intended for use in a hand labeling device in which it provides self-adhesive labels with a price imprint or the like and these labels can then be applied by means of the labeling device to an article. To obtain different price imprints the individual type carriers in the printing mechanism must be adjusted so that the desired printing types move into the printing position. This adjustment can be achieved by suitable turning and displacement of the setting shaft by means of the actuating knob. The actuating knob projects laterally from the housing of the printing mechanism and in the specifically mentioned use also projects laterally at the housing of the hand labeling device so that the printing types can be set without removing the printing mechanism from the device housing. The indicator device serving to check the particular setting operations to be made is connected to the end portion of the setting shaft carrying the actuating knob via a web which by means of a hub surrounds the end portion, then extends radially and at its end carries the indicating device extending parallel to the axis of the setting shaft. To facilitate the adjustment operation of the type carriers for the user it is expedient for the actuating knob to be as easily accessible as possible and project a long way laterally out of the housing. However, the extensive projection is disadvantageous in the handling of the labeling device because the operator can easily bump against objects with the actuating knob or the latter can get stuck somewhere and this can even lead to damaging of the printing mechanism. A reduction of the projection of the actuating knob makes operation considerably more difficult because it can then happen that the operator catches his fingers engaging the actuating knob during the turning movement on the web carrying the indicating means. This could be avoided only be gripping the actuating knob with the fingertips but this makes turning it more difficult. In the known printing mechanism to improve the easy operation an actuating knob is used which is axially displaceable on the setting shaft and which when the setting operations have been carried out can be pushed back into a less projecting position. The use of the actuating knob displaceable relatively to the setting shaft is however unfavourable as regards a clear association between the position of the actuating knob and the position of the indicating means. The operator must always first make sure by exact observation of the indicating means which position the setting shaft assumes whereas in printing mechanisms with axially fixed actuating knob the position of the latter itself also contributes to recognizing the position of the setting shaft. The displacement of the actuating knob before adjusting the setting shaft is an additional operating step which is troublesome in particular when the setting wheel to be adjusted with completely inserted setting shaft is to be influenced.

The fact that a greatly projecting knob is a problem for whose solution a comprise must be found between ease of operation and avoiding damage is also shown by the step adopted in the commercially available devices of the company ESSELTE METO GMBH, Hirschhorn. In such a device belonging to the series "METO NEW LINE" and having the type designation 5.26 at the housing wall of the labeling device in which the printing mechanism is used an outwardly projecting pocket is formed which projects further than the actuating knob on the printing mechanism. If the operator bumps against an article with the device housing the pocket protects the actuating knob from impacts so that in this device a relatively greatly projecting actuating knob can be used as is required for ease of operation.

The problem underlying the invention is to further develop a printing mechanism of the type outlined at the beginning such that ease of operation is achieved with an operating knob which projects only slightly laterally.

This problem is solved according to the invention in that the connection between the end portion of the setting shaft carrying the actuating knob and the display indicating means is formed by a substantially circular cap which is mounted with a hub on the end portion of the setting shaft and on the edge of which the display indicating means is secured. When using the cap as connecting element between the setting shaft and the display indicating means a closed surface results adjoining the actuating knob in the direction towards the setting shaft. Even when the actuating knob is made relatively narrow and projects only a slight extent there is no danger that on gripping and turning the actuating knob the operator can catch his fingers on the connection between the setting shaft and the display indicating means because the finger pads slide along the closed surface formed by the cap. Consequently, the operator need not pay particular attention when gripping the actuating knob.

In an advantageous further development of the invention the cap has the form of a cone tapering towards the hub. This further development provides somewhat more space for the fingers of the operator on gripping the actuating knob.

Figure 2:
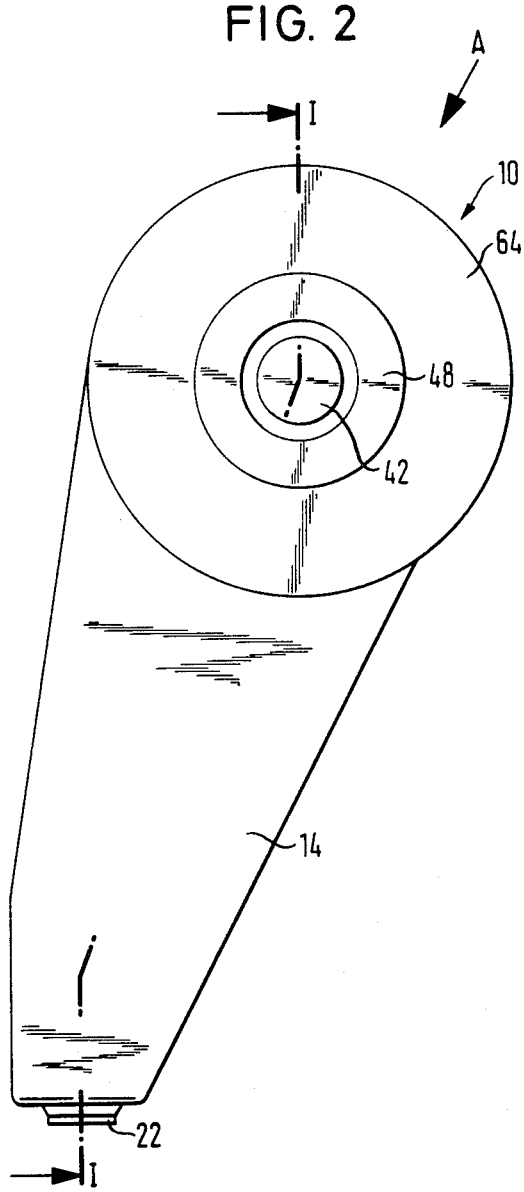
Figure 3:
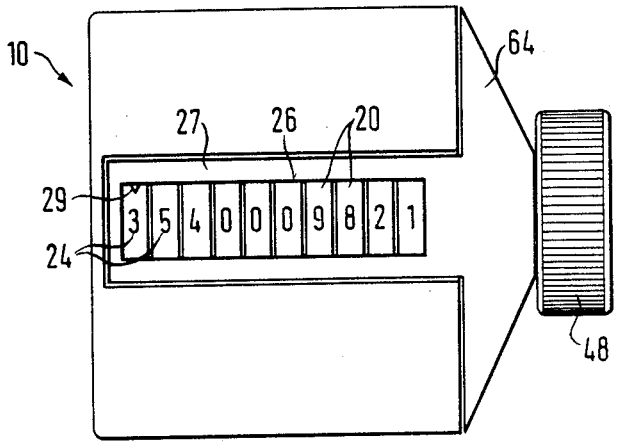

An example of embodiment of the invention will now be described with reference to the drawings, wherein:

FIG. 1 is a section of the printing mechanism according to the invention along the line I—I of FIG. 2, FIG. 2 is a view of the side of the printing mechanism at which the actuating knob is mounted and FIG. 3 is a plan view of the printing mechanism according to the invention in the direction of the arrow A of FIG. 2.

The printing mechanism 10 illustrated in FIG. 1 comprises a printing mechanism housing which is made up of two housing halves 12 and 14 and in which a plurality of parallel adjacent type carriers 20 are accommodated which are constructed as bands or tapes and led round setting wheels 16 and a deflection edge 18. The carriers 20 carry on one half of their outer peripheral surface printing types 22 and on the other half indicator types 24. The association of the printing types 22 to the indicator types 24 is such that the particular printing types 22 disposed in the printing position at the deflection edge 18 and the particular indicator types 24 visible through a window 26 disposed at the housing upper side represent the same number, the same letter or the like. This means that it can always be seen through the window 26 at the housing upper side which characters can be printed on a record carrier with the printing types 22 disposed at the bottom at the deflection edge.

As already mentioned the type carriers 20 are led round setting wheels 16 which are rotatably mounted on a sleeve 28. In the sleeve 28 at least one slot 30 is disposed which is open at the sleeve end lying on the right in FIG. 1. Through this slot a tooth 36 engages which is disposed on a setting shaft 42. The setting shaft 42 is axially displaceable in a bearing passage 44 in the housing half 14. By displacement of the setting shaft 42 in the axial direction said shaft can be brought into drive connection with the setting wheels 16 by engagement of the tooth 36 in one of several recesses 46 in the hub regions of said wheels.

At the portion 45 of the setting shaft 42 projecting from the housing an actuating knob 48 is disposed with the aid of which the shaft can firstly be axially displaced and secondly rotated. By the axial displacement of the setting shaft 42 the tooth 36 disposed thereon is first brought into engagement with one of the recesses 46 of a setting wheel 16 to be adjusted and by rotation of the setting shaft 42 the type carrier 20 led round the periphery thereof is moved until a desired printing type 22 is in the printing position beneath the deflection edge 18. As already mentioned the particular position of the printing types 22 can be checked through the window 26 disposed at the top of the housing. To establish a drive connection between the type carriers 20 and the setting wheels 16 the type carriers 20 comprise at their inner surface teeth which engage in recesses in the outer peripheral surfaces of the setting wheels 16.

To obtain an exact alignment of the plane of the tooth 36 with the plane of the particular setting wheel 16 to be adjusted a detent mechanism is provided which insures that the setting shaft on axial displacement thereof always engages in a manner clearly felt by the operator in positions in which a clear drive connection with a setting wheel 16 to be adjusted is established. This detent mechanism comprises a detent finger 54 integrally formed on the sleeve 28, said finger projecting radially inwardly at the sleeve inner surface and engaging in detent recesses 56 which are disposed in a region of the outer peripheral surface of the setting shaft 42. A detent recess 56 is provided for each of the setting wheels 16 mounted on the sleeve 28. If in the arrangement of the individual parts illustrated in FIG. 1 in which the setting shaft 42 is in engagement with the setting wheel 16 on the extreme left the setting shaft 42 is moved to the right so that it comes into engagement for example with the next setting wheel 16 firstly the detent force exerted by the detent finger 52 on the setting shaft 42 must be overcome when it is moved out of the associated detent recess 56 upwardly in the illustration of FIG. 1; it can then drop into the next detent recess 56 which happens exactly when the setting shaft 42 is in engagement with the second setting wheel 16 from the left.

As apparent from FIG. 1 the setting shaft 42 extends in the portion 45 directly adjoining the actuating knob 48 through a hub 62 which is disposed on a conical cap 64. This cap carries a frame 27 which surrounds the window 26 and is displaceably mounted at the top on the housing. When the setting shaft 42 is axially displaced the frame 27 with the window 26 also moves, the left end of the inspection window in FIG. 1 lying precisely in the plane of the setting wheel 16 with which the setting shaft 42 is in engagement. The frame 27 thus forms with its window 26 and marking arrow 29 a display indicating means and by observing the left end of the window 26 the operator thus knows in any axial position of the setting shaft 42 which particular type carrier 20 can be brought into the desired position. A marking arrow 29 visible in FIG. 3 on the frame 27 facilitates recognition of the particular type carrier 20 to be adjusted.

To insure that on rotating the setting wheels and the setting of the type carriers 20 thus made the operator performs the individual adjustment operations always until a printing type 22 is exactly in the printing position at the deflection edge 18, a further detent mechanism is provided which facilitates the exact adjustment for the operator. This detent mechanism consists of a helical spring 66 which is disposed parallel to the longitudinal axis of the setting shaft 42 at the periphery of the setting wheels 16 in such a manner that it partially penetrates into the recesses 52 at the periphery of the setting wheels 16, as clearly apparent in FIG. 1. To enable the setting wheels 16 to be turned in spite of the engagement of the helical spring 66 in their recesses the helical spring 66 is mounted on a resiliently yieldable cushion 68. On turning of the setting wheels 16 the helical spring 66 can thus yield and embed itself in the cushion 68. The operator therefore feels on turning the setting wheels to a position in which a tooth lying between the recesses 52 is moved towards the helical spring 66 firstly an increase of the turning force to be applied, which then again decreases when the helical spring engages in the next recess 52. The operator thus feels clear force peaks and knows that whenever he has overcome a force peak a printing type 22 is in the exact printing position beneath the deflection edge 18.

The cap 64 joining the portion 45 of the setting shaft 42 to the frame 27 containing the window 26 has according to FIGS. 1 and 3 a conical form towards the actuating knob. According to FIG. 2 it completely covers the upper part of the printing mechanism when the setting shaft 42 is pushed completely into the printing mechanism as is the case in FIGS. 1 and 3. Since the cap 64 forms a closed surface gripping and turning of the actuating knob 48 is not obstructed even when the actuating knob 48 is relatively narrow so that the finger pads of the operator project inwardly in the direction towards the cap 64 beyond the actuating knob 48. On turning of the actuating knob 48 the finger pads can easily slide over the smooth outer surface of the cap 64. The lateral projection and thickness of the actuating knob can thus be kept small. By using the conical cap 64 in addition the stability of the connection between the setting shaft 42 and the frame 27 is considerably improved.

As shown by FIGS. 2 and 3 the cap 64 also makes an excellent contribution to protecting the printing mechanism from the penetration of dirt, etc, because in the completely inserted condition of the setting shaft its bearing region is well sealed off.

According to FIG. 1 the cap 64 carries at its end diametrically opposite the frame 27 a pin 70 which projects through a passage 72 in the housing half 14 into the cavity surrounded by the helical spring 66. This pin 70 contributes inter alia to an improvement of the guide of the cap 64 because the edge thereof is guided thereby at two diametrically opposite points on displacement axially of the setting shaft. The described printing mechanism is intended for use in a hand labeling device in which it can produce price imprints and the like on self-adhesive labels by being moved relatively to the housing of the device downwardly in the view of FIG. 1.

The wall of the device housing extends in spaced parallel relationship with the printing mechanism housing half 14 up to just below the pin 70. When the setting shaft 42 is moved out of the position illustrated in FIG. 1 to the right in order to be able to adjust the type carriers 20 lying further to the right the actuating knob projects to an undesirably great extent out of the housing of the labeling device. In this position of the setting shaft the pin 70 prevents actuation of the labeling device, which involves lowering of the printing mechansim. For on lowering of the printing mechanism the pin 70 strikes against the wall of the device housing so that the operator is reminded that the setting shaft must be returned to the position illustrated in FIG. 1 again before he can operate the device once more.

The conical path of the cap outer surface can be utilized in conjunction with the wall of the device housing to effect an automatic return of the setting shaft into the completely inserted position when the printing mechanism is lowered on actuating the device and the setting shaft is still slightly pulled out.

I claim:

1. Printing mechanism comprising a housing in which a plurality of type carriers are disposed which are in a drive connection with coaxially arranged setting wheels each having a center bore, a setting shaft which is arranged axially displaceably and rotatably in the space formed by the center bores of the setting wheels and axially displaceable into a drive connection with each of the setting wheels, an actuating knob disposed on an end portion of the setting shaft for displacement and rotation of the setting shaft and an display indicating means which is arranged in the housing displaceably parallel to the setting shaft and connected to the one end portion of the setting shaft in such a manner that the latter can rotate relatively thereto but is axially displaceable only jointly therewith, the indicating means being associated with the type carriers in such a manner that its position shows which type carrier in the respective axial position of the setting shaft can be adjusted via the drive connection between the latter and a setting wheel and between the setting wheel and the type carrier, characterized in that the connection between the end portion (45) of the setting shaft (42) carrying the actuating knob (48) and the display indicating means (26, 27, 29) is formed by a substantially circular cap (64) which has a hub (62) mounted on the end portion (45) of the setting shaft (42) and the display indicating means (26, 27, 29) is secured to the edge of the cap.

2. Printing mechanism according to claim 1, characterized in that the cap (64) has the form of a cone tapering towards the hub (62).

3. Printing mechanism according to claim 1 or 2, characterized in that the display indicating means (26, 27) is made integral with the cap (64).

4. Printing mechanism according to claim 3, characterized in that at the edge of the cap (64) at a point diametrically opposite the display indicating means (26, 27, 29) a pin (70) is integrally formed which extends parallel to the setting shaft (42) and projects into a passage (72) disposed in the housing (14).

5. Printing mechanism according to claims 1 or 2, characterized in that at the edge of the cap (64) at a point diametrically opposite the display indicating means (26, 27, 29) a pin (70) is integrally formed which extends parallel to the setting shaft (42) and projects into a passage (72) disposed in the housing (14).

* * * * *